United States Patent [19]

George

[11] 3,968,284

[45] July 6, 1976

[54] BREATHABLE FLAME RESISTANT FABRIC CONSTRUCTION AND METHOD OF MAKING SAME

[76] Inventor: Stephen George, 247 Swinton Ave., Bronx, N.Y. 10465

[22] Filed: July 1, 1974

[21] Appl. No.: 484,562

[52] U.S. Cl. ..... 428/90; 427/206; 427/333; 428/95; 428/268; 428/921

[51] Int. Cl.[2] ..... B05D 1/14; B05D 1/16; B05D 1/36

[58] Field of Search ..... 117/17, 33, 76 T, 126 GB, 117/136; 428/90, 921, 268, 95; 427/206, 333

[56] References Cited

UNITED STATES PATENTS

| | | | |
|---|---|---|---|
| 2,122,514 | 7/1938 | Crocker et al. | 117/136 |
| 2,431,745 | 12/1947 | Flanagan | 117/76 T X |
| 3,065,096 | 11/1962 | Marsden | 427/333 |
| 3,085,896 | 4/1963 | Britt et al. | 117/76 T X |
| 3,416,948 | 12/1968 | Maurer | 117/76 T |
| 3,501,329 | 3/1970 | Kent | 117/33 |
| 3,533,826 | 10/1970 | Falgiatore | 117/33 |
| 3,666,522 | 5/1972 | George | 117/33 |

FOREIGN PATENTS OR APPLICATIONS

| | | |
|---|---|---|
| 727,163 | 3/1955 | United Kingdom |

*Primary Examiner*—Harry J. Gwinnell
*Assistant Examiner*—Shrive P. Beck
*Attorney, Agent, or Firm*—Robert W. Fiddler

[57] ABSTRACT

A breathable flame resistant fabric construction having a pile surface providing desired hand and dyeability, along with the porosity necessary to provide breathability. The fabric construction is formed by bonding flock fibers to the surface of a fiberglass base fabric by means of a polymeric adhesive which in the presence of heat will release flame quenching gases, blocking the flow of oxygen to the normally flammable flock fibers. It has been found that if the base fabric is first coated with a plasticizer before applying the polymeric adhesive, such as employed to secure the flock fibers to the fiberglass, the subsequently applied adhesive will coat the fiberglass yarns constituting the fabric without producing an adhesive film extending over the spaces between yarns, leaving air passing interstices in the fiberglass base fabric, and additionally improve the hand of the base fabric by providing for an increase in "elastic slippage" (i.e. slippage permitting distortion with a subsequent return to original condition) between the yarns making up the base fabric, thus increasing flexibility of the base fabric, and the composite fabric construction.

11 Claims, 3 Drawing Figures

BREATHABLE FLAME RESISTANT FABRIC CONSTRUCTION AND METHOD OF MAKING SAME

BACKGROUND OF THE INVENTION

This invention relates to the art of fire retardant fabric constructions, and more particularly to an improved fire retardant fabric construction, providing a fabric having a pile surface providing desired hand and dyeability, along with desired flexibility and breathability implementing use of the fabric in upholstery applications.

The general flammability of textile fabrics, seriously limits the utilization of these fabrics in situations where fire hazards may exist. A variety of attempts have been made over the years to reduce the flammability of various textile fabrics, and under the Flammable Fabrics Act, standards have been established for determining flammability of the fabric.

In the current state of the art, attempts have been made to render textile fabrics fireproof by: (1) applying a variety of fire retardant finishes, or (2) constructing the fabric of inherently flame retardant fibers such as asbestos, fiberglass, and a variety of synthetics.

The fire retardant finishes which have been evolved for use on fabrics generally involve the impregnation of the fibers with fire retardant chemicals and reactants followed by drying. It is found, however, that most of these finishes are removed from the fabric during washing or dry-cleaning and often the finish interacts with normal surface accumulations on the fabric to deteriorate the fabric and at times increase its flammability.

In utilizing inherently flameproof fibers for constructing fabrics, a variety of problems arise. Thus, in forming the fabric of asbestos, the physical and esthetic characteristics of asbestos due to the relatively short staple length and frangibility of the asbestos fibers make them unsuitable for use in upholstery or other furnishing applications. Further, recent findings linking asbestos to cancer have made the use of asbestos undesirable.

Obtaining a desired hand, and dyeing of the synthetics also present problems. In using the flame retardant synthetics, it is found that though these synthetics do not burn, they decompose in the presence of a flame or burning ash, some of them giving off toxic funes, and all of them physically deteriorating at temperatures such as might be encountered in the presence of a fire, so that when used in upholstery, a dropped cigarette, though not burning the fabric, will destroy the fabric, exposing the upholstery padding which is then subject to ignition.

Fiberglass, which has been in use since the middle 1930's, though suitable for draperies and curtains, is relatively stiff, preventing desired draping to conform to the contours of upholstered pieces, and is difficult and expensive to dye, requiring the use of special pigment bonding resins, and further the allergic reaction of many individuals to the fiberglass fibers prevents use of fiberglass as a seating surface.

Applicant, in his prior U.S. Pat. No. 3,666,522, has discovered a fabric construction implementing the utilization of fiberglass as a base fabric, treated to provide desired hand and dyeability while retaining the fire retardant benefits of fiberglass. This is done in accordance with applicant's prior patent by applying flock fibers with one end adhered to said base fabric, utilizing a heat responsive adhesive coating to adhere the flock fibers to the fiberglass base fabric, with the adhesive generating oxygen quenching gas in the presence of heat.

Though the fabric construction provided by applicant's prior patent provides the flame retardant properties of fiberglass, while eliminating the undesired hand and lack of dyeability of fiberglass, it has been found that the adhesive employed in securing the flock fibers to the glass surfaces substantially eliminates any porosity in the fiberglass fabric, so that when the fabric of this prior patent is employed as a seating surface on an upholstered piece, the lack of breathability makes the surface uncomfortable.

SUMMARY OF THE INVENTION

It is with the above considerations in mind that the present improved fabric construction has been evolved providing a breathable flame resistant fabric subject to ready dyeing, and with desired hand and requisite flexibility to provide for ready draping to the contours of an upholstered piece permitting use of the fabric for upholstery purposes.

It is accordingly among the primary objects of this invention to provide an improved flame resistant fabric.

A further object of the invention is to provide a flame resistant fabric which is breathable, flexible and has a desired hand or surface texture.

An additional important object of this invention is to provide a flame resistant fabric particularly suitable to upholstery applications.

Another object of the invention is to provide a flame resistant fabric which will retain its structural integrity in the presence of flame, and will resist burnthrough or ignition by smoldering cigars, cigarettes or ashes.

A further object of the invention is to provide a flame resistant fabric which is shrink resistant, and subject to ready printing or dyeing.

These and other objects of the invention which will become hereafter apparent are achieved by forming a composite fabric with a fiberglass base fabric coated with a plasticizer surrounding the yarn of the fiberglass base fabric but not extending through the interstices of the yarns comprising the base fabric. Flock fibers, preferably of cotton or rayon, are applied with one end adhering to the fiberglass base fabric by means of a polymeric adhesive which is applied over the heretofore applied plasticizer. The polymeric adhesive is of a type which in the presence of heat releases a flame quenching gas. By virtue of the previous application of the plasticizer to the base fabric, it is found that the application of the polymeric adhesive results in the adhesive being bonded to the fiberglass yarns, with little or no adhesive extending through the interstices between the yarns. The plasticizer mixes with the polymeric adhesive. However, the concentration of plasticizer in the adhesive is greatest adjacent the fiberglass yarn with a resultant gradually increasing gradient of hardness in the adhesive as measured in moving away from the fiberglass, so that the polymeric adhesive is softer adjacent the fiberglass yarns, and relatively hard adjacent the flock fibers with the result that there is a hard bond to the flock fibers and a relatively flexible bond to the fiberglass yarns. The softness of bond adjacent the fiberglass serves to provide a flexibility of bond between the fiberglass yarns in a relatively elastic fashion providing for desired yarn stability in a fabric with desired "elastic slippage" (i.e. slippage permitting distortion with subsequent return to original condition.

A feature of the invention resides in the fact that the plasticizer applied to the fiberglass yarns before application of the polymeric flock adhesive provides the twofold function of (1) minimizing accumulations of adhesive in the interstices between the yarns of which the base fabric is constituted, thus providing a requisite porosity to provide desired breathability, and (2) providing a relatively flexible bond between the fiberglass yarns due to the relatively high degree of plasticizer in the adhesive adjacent the fiberglass yarns, serving to increase fabric stability while at the same time promoting flexibility of the fabric due to elastic shifting of adjacent yarns.

A further feature of the invention resides in the increased flex strength of the fiberglass substrate due to its impregnation with a highly plasticized polymer, which minimizes yarn fracturing of the substrate.

BRIEF DESCRIPTION OF THE DRAWINGS

The specific details of a preferred embodiment of the invention, the manner and process of using it, and the best mode contemplated by the inventor, will be made most manifest and particularly pointed out in clear, concise and exact terms in conjunction with the accompanying drawings, wherein.

DESCRIPTION OF PREFERRED EMBODIMENT

Referring now more particularly to the drawings, like numerals in the various illustrative figures will be employed to designate like parts.

Figure 2:
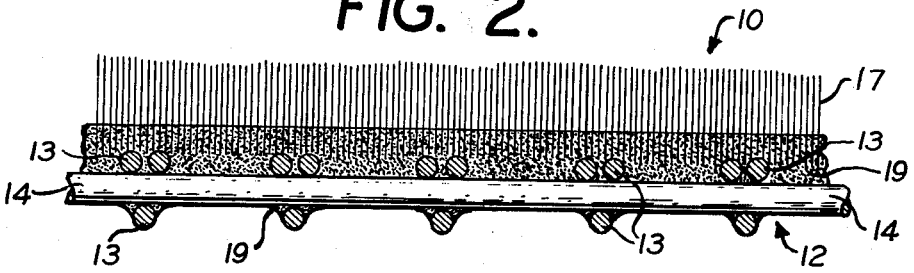
FIG. 2 is an enlarged detail cross-sectional schematic view of the fabric construction.

The flame resistant fabric construction 10 as shown in FIG. 2 is illustratively shown as constructed of a knit fiberglass substrate base fabric 12 having knit yarns 13 and fill yarns 14.

Satisfactory results have been obtained employing knit yarns 13 comprised of Beta type fiberglass with a yarn designation of B-450$^2/_2$; with fill or lay in yarns 14 comprised of fiberglass with a yarn designation of B-150 ½.

Figure 1:
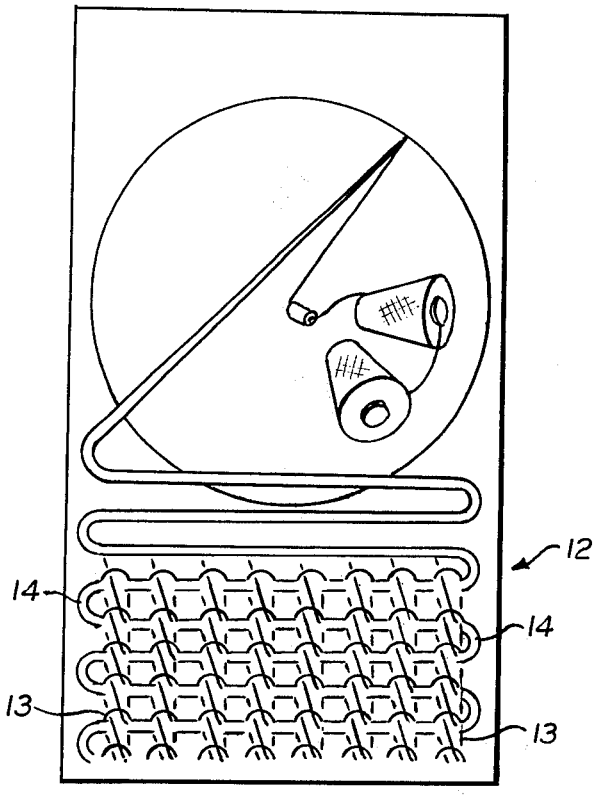
FIG. 1 is an enlarged plane schematic view showing the construction of the knit fiberglass substrate fabric.

The knit fiberglass substrate fabric 12 used in the illustrative preferred embodiment of fabric construction may be produced on warp knitting machinery such as the "Turbotex" knitting machine manufactured by W. Barfuss & Co., D-4050 Monchengladbach, Germany, (warp knit fabric construction produced on this machine is schematically illustrated in FIG. 1); or Raschel type warp knitting machines, manufactured by Karl Mayer, GmbH, Germany; Liba, GmbH, Germany; Rockwell International, U.S.A.; and The Kidde Textile Machine Company, U.S.A. with the following preferred specifications:

| | |
|---|---|
| Fabric Thickness: | .016 |
| Fabric Weight: | 9 ounces per square yard |
| Knit Pattern: | Cable stitch and weft lay in |
| Knit Construction: | Knit Yarn - cable stitch; 21 knitting stitches per inch of fabric width. Lay in Yarn - weft lay in; 42 stitches or courses per inch of fabric length. |
| Yarn Designation: | Knit Yarn - Beta fiberglass B - 450 2/2 Lay in Yarn - Beta fiberglass B - 150 1/2 |

As will be understood by those skilled in the art, the knit fiberglass substrate fabric 12 though preferably formed of all fiberglass yarns, may be constructed with other kinds of fire retardant knit yarns 13 or with only the weft lay in yarn 14 comprised of fiberglass. The substrate may also be a woven fiberglass.

It is preferred that the base fabric has a coarseness such that the maximum thickness of the knit fabric at a point where yarns cross be at least 30% to 70% greater than the fabric thickness in areas of minimum thickness.

Figure 3:
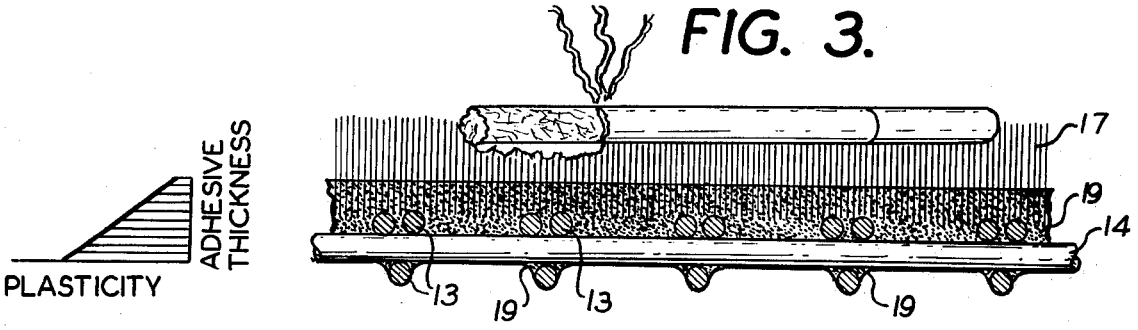
FIG. 3 is an enlarged detail cross-sectional schematic view of the fabric construction with a graph arranged adjacent the side of the fabric illustrating the gradient of decreased plasticity and accompanying softness as measured in moving away from the fiberglass base fabric towards the free ends of the flock fibers.

As illustratively shown in FIG. 3, the base fabric 12 has flock fibers 17 adhered thereto by means of an adhesive 19. A variety of flock fibers may be employed. Flock fibers of cotton, nylon, polyester, and wool have been found satisfactory. In a preferred embodiment, precision cut rayon flock fibers have been used 0.03 inches in length and of a 3.0 denier, which is applied at a surface density distribution of 5 ounces of flock fibers per square yard of base fabric.

The flock adhesive 19 is polymeric adhesive which may be made up of a number of formulations. The following examples being illustrative of adhesive formulations which, upon exposure to a flame or a temperature increase sufficient to cause combustion, will block the flow of oxygen to the normally flammable rayon flock fibers 17 and any flammable stitching threads used in subsequent sewing and fabrication of the fabric.

Adhesive Example 1

| | | Materials | Parts By Weight As Is |
|---|---|---|---|
| 1. | Resin - | Geon 660x4 - Vinylidene Chloride Copolymer B.F. Goodrich Chemical Co., Cleveland, Ohio Description: 53% solids in water | 197. |
| 2. | Resin - | Geon 660x2 - Vinylidene Chloride Copolymer B.F. Goodrich Chemical Co., Cleveland, Ohio Description: 50% solids in water | 35. |
| 3. | Titanium Dioxide | Description: 60% concentrate in water slurry | 60. |
| 4. | Antimony Oxide | | 30. |

-continued

Adhesive Example 1

| | Materials | Parts By Weight As Is |
|---|---|---|
| | Description: 60% concentrate in water slurry | |
| 5. | DF - 160 - L Defoamer<br>Nopco Div. of Diamond Shamrock Chemical Co.<br>Description: 50% concentrate in water | 0.5 |
| 6. | Dowicil - 100 - Biocide<br>Description: 50% concentrate in water | 1. |
| 7. | Tetrasodium Pyrophosphate (TSPP)<br>Description: Anhydrous Powdered 10% concentrate in water | 4.5 |
| 8. | Hydroxyethyl Cellulose - HEC - Thickening Agent<br>Description: 10% concentrate in water | 15. |
| | | 343. |

Adhesive Example 2

| | | Materials | Parts By Weights As Is |
|---|---|---|---|
| 1. | Resin - | Geon 950x1 - Vinyl Chloride Copolymer containing Halogenated Phosphorus<br>B.F. Goodrich Chemical Co., Cleveland, Ohio<br>Description: 53% solids in water | 197. |
| 2. | Resin - | Geon 660x2 - Vinylidene Chloride Copolymer<br>B.F. Goodrich Chemical Co., Cleveland, Ohio<br>Description: 50% solids in water | 35. |
| 3. | Titanium Dioxide<br>Description: 60% concentrate in water slurry | | 60. |
| 4. | Antimony Oxide<br>Description: 60% concentrate in water slurry | | 30. |
| 5. | DF - 160 - L Defoamer<br>Nopco Div. of Diamond Shamrock Chemical Co.<br>Description: 50% concentrate in water | | 0.5 |
| 6. | Dowicil - 100 - Biocide<br>Description: 50% concentrate in water | | 1. |
| 7. | Tetrasodium Pyrophosphate (TSPP)<br>Description: Anhydrous Powdered 10% concentrate in water | | 4.5 |
| 8. | Hydroxyethyl Cellulose - HEC - Thickening Agent<br>Description: 10% concentrate in water | | 15. |
| | | | 343. |

Adhesive Example 3

| | | Materials | Parts By Weights As Is |
|---|---|---|---|
| 1. | Resin - | RC - 546 - Vinylidene Chloride Copolymer<br>Rohm & Haas Co., Philadelphia, Penna.<br>Description: 50% solids in water | 197. |
| 2. | Resin - | Geon 460x6 - Vinyl Chloride Copolymer<br>B.F. Goodrich Chemical Co., Cleveland, Ohio<br>Description: 50% solids in water | 35. |
| 3. | Titanium Dioxide<br>Description: 60% concentrate in water slurry | | 60. |
| 4. | Antimony Oxide<br>Description: 60% concentrate in water slurry | | 30. |
| 5. | DF - 160 - L Defoamer<br>Nopco Div. Diamond Shamrock Chemical Co.<br>Description: 50% concentrate in water | | 0.5 |
| 6. | Dowicil - 100 - Biocide<br>Description: 50% concentrate in water | | 1. |
| 7. | Tetrasodium Pyrophosphate (TSPP)<br>Description: Anhydrous Powdered 10% concentrate in water | | 4.5 |

-continued

Adhesive Example 3

| Materials | Parts By Weights As Is |
|---|---|
| 8. Hydroxyethyl Cellulose - HEC - Thickening Agent Description: 10% concentrate in water | 15. |
| | 343. |

Additionally, the adhesive formulations set forth in my prior U.S. Pat. No. 3,666,522, may be employed.

In forming the above described fabric construction 10 in accordance with the invention, the adhesive 19 is provided with a diminishing gradient of plasticity as illustratively shown in the graph of FIG. 3 with plasticity decreasing further from the base fabric 12. This is accomplished by coating the substrate fabric 12 with a plasticizer such as tricresyl phosphate (TCP) before applying the polymeric adhesive 19. In accordance with a preferred embodiment of the invention, a gravure type engraved roll may satisfactorily be employed to apply a surface coating of TCP to the base fiberglass fabric 12. It is found that a plasticizer coating of between 5% and 20% of the adhesive thickness gives satisfactory results.

Immediately after application to the base fabric 12 of the plasticizer, TCP in the preferred embodiment, the polymeric flock adhesive as set forth in the above examples is applied. Thereafter, the flock is deposited, preferably electrostatically.

Some examples of the fabric construction are given below:

| | | |
|---|---|---|
| Fabric Construction Example I | | |
| Base Fabric | - | Knit fiberglass |
| Weave | - | Cable stitch 21 wales × 42 weft |
| Yarn | - | Beta fiberglass |
| Weight | - | 9 ounces per square yard |
| Thickness | - | .016 inch |
| Plasticizer | - | TCP .001 inch |
| Adhesive | - | As set forth in examples 1–3 above .014" wet thickness |
| Flock | - | Electrostatically deposited rayon |
| Length | - | 3" |
| Denier | - | 3 |
| Distribution | - | 5 ounces per square yard |
| Fabric Construction Example II | | |
| Base Fabric | - | Fiberglass |
| Weave | - | Twill 3.1 |
| Weight | - | 4.3 ounces per square yard |
| Thickness | - | .0047" |
| Plasticizer | - | TCP .001 inch |
| Adhesive | - | As set forth in examples 1–3 above .014" wet thickness |
| Flock | - | Electrostatically deposited rayon |
| Length | - | .03" |
| Denier | - | 3 |
| Disbribution | - | 5 ounces per square yard |

In forming the fabric constructions above described, it is preferred to apply to the flame retardant fiberglass substrate fabric 12 a .001 of an inch surface coating of the tricresyl phosphate (TCP) plasticizer by means of a gravure type engraved roll. Immediately after application of the plasticizer, a polymeric flock adhesive coating 19 is applied of 0.014 inch wet thickness, approximately 55.3% solids at a viscosity of 40,000 cps (formulation herein described) such that it adheres to the face of the substrate fabric as shown in FIG. 2.

Thereafter, precision cut rayon flock fibers 17 of a length of 0.03 inch and a denier of 3 are electrostatically deposited on the freshly applied adhesive coating 19, at a density of approximately 5 ounces per square yard. The fibers are vertically oriented with their ends embedded approximately .008 inch into the wet adhesive. When dried and cured, the flock adhesive 19 will have a dry film thickness of 0.007 inch in which the ends of the flock fibers will be embedded approximately 0.004 inches and bonded to the substrate fabric 12. It will be noted that the precision cut flock fibers 7 are 0.030 inch in length of which only 0.004 inch are embedded into the adhesive, leaving the remaining 0.026 inch length completely free of adhesive or coatings (it being preferred that at least 50% of the length of the flock be free of adhesive), such that the hand and dyeing or printing characteristics of the fibers are not altered or adversely affected. The flock adhesive 19 is dryed and cured at 300°F. for 3 minutes. All unadhered flock is removed from the surface of the fabric by vacuuming, electrostatically, or the like.

The method wherein normally combustible flock fibers are bonded to a base fiberglass fabric with a heat responsive flock adhesive which in the presence of heat prevents the flow of oxygen to the flock fibers, thereby creating a fire retardant flock surfaced fabric, was originally disclosed in my U.S. Pat. No. 3,666,522 issued on May 30, 1972.

OPERATION

It has been found that the application of the plasticizer to the base fabric prior to application of the polymeric flock adhesive serves to provide a gradient of plasticity in the polymeric flock adhesive whereby the adhesive at a point remote from the base fabric is relatively harder than the adhesive at the base fabric. As a result the relatively hard adhesive remote from the base fabric securely engages the flock fibers which, as described, extend up from the adhesive.

At the base fabric surface, the initial application of the plasticizer serves as a wetting agent so that the subsequently applied polymeric flock adhesive provides a surface coating for the yarns of the base fabric and there is a noticeably reduced tendency of the adhesive to film over the spaces between yarns, thereby leaving the normal base fabric bonds unfilled to provide a breathable construction.

Further, the relatively soft adhesive having a greater quantity of plasticizer at the base fabric provides an elastic interlock between base fabric yarns so that the elasticity of the fabric construction is improved.

When the fabric construction is subjected to a flame or the intense heat of a flame, the flock adhesive 19 will decompose without flaming, releasing flame quenching gases that block the flow of oxygen to the normally flammable flock fibers. Continued exposure to heat and/or flame causes both the flock fibers and bonding adhesive to carbonize, without flaming and fuse to the surface of the fiberglass knit fabric. The carbonized flock fiber and flock adhesive form a non-combustible, high temperature carbon heat shield fused to the surface of the knit fiberglass base fabric. The carbon embedded in the fabric surface has a melt temperature in excess of 2,000° F. which protects and greatly improves the ability of the fiberglass base fabric, (fiberglass begins losing tensile strength at 800° F. and softens at about 1,350° F.), to resist heat and elevated temperatures. The composite fabric construction will also resist burn through or flammable ignition caused by smoldering cigars or cigarettes as the fabric cannot be burned through at the temperatures reached by these smoking materials (approximately 900° F.).

It is thus seen that an improved breathable flame resistant fabric construction has been provided which is relatively flexible and having desired hand and dyeability.

The above disclosure has been given by way of illustration and elucidation, and not by way of limitation, and it is desired to protect all embodiments of the herein disclosed inventive concept within the scope of the appended claims.

What is claimed is:

1. A flame resistant fabric construction comprising:
a porous fiberglass base fabric;
a polymeric heat responsive adhesive coating on said base fabric, said adhesive coating not extending through the interstices of the base fabric, said adhesive coating releasing flame quenching gases when said adhesive is subject to flame;
and flock fibers embedded in said adhesive coating with one end of the fibers upstanding from said adhesive coating;
said adhesive coating containing a greater concentration of plasticizer adjacent the fiberglass fabric than the portion of the adhesive in the area of the flock with a resultant gradually increasing gradient of hardness in the adhesive coating as measured in moving away from the base fabric.

2. A flame resistant fabric construction as in claim 1 in which said flock fibers have at least half their length exposed over the upper surface of the adhesive.

3. A flame resistant fabric construction as in claim 1 in which said flock fibers are natural fibers.

4. A flame resistant fabric construction as in claim 1 in which said flock fibers are synthetic fibers.

5. A flame resistant fabric construction as in claim 1 in which said plasticizer is applied to the base fabric before application of said adhesive.

6. A flame resistant fabric construction as in claim 1 in which said adhesive coating is applied to said base fabric with voids corresponding with the openings in said porous base fabric.

7. A flame resistant fabric construction as in claim 1 in which the yarns of said base fabric are elastically coupled by said plasticized adhesive.

8. A method of forming a flame resistant fabric said method comprising the steps of:
applying a plasticizer to a fiberglass base fabric;
applying a polymeric heat responsive adhesive coating reacting to heat to block the flow of oxygen over said plasticizer coated fiberglass and mixing with the plasticizer so that the plasticizer is more heavily concentrated in the adhesive coating adjacent the base fabric producing a gradually increasing gradient of hardness in the adhesive as measured in moving away from the base fabric; and
depositing on the adhesive coating a plurality of flock fibers with one end of the flock fiber embedded in the adhesive and the other end of the flock fiber upstanding from the fiberglass base fabric.

9. A method of forming a flame resistant fabric as in claim 8 in which the flock is electrostatically deposited on the adhesive coated base fabric with at least 50% of the length of the flock fibers extending above the adhesive.

10. A method of forming a flame resistant base fabric as in claim 8 in which the plasticizer applied to the base fabric is applied in a coating of between 5% and 20% of the thickness of the subsequently applied polymeric adhesive.

11. A method of forming a flame resistant base fabric as in claim 8 in which the plasticizer and adhesive are applied to the base fabric leaving voids therein.

* * * * *